US008509660B2

(12) United States Patent
Sato et al.

(10) Patent No.: US 8,509,660 B2
(45) Date of Patent: Aug. 13, 2013

(54) DEVELOPING APPARATUS AND PROCESS CARTRIDGE

(75) Inventors: Masaaki Sato, Yokohama (JP); Hideki Kakuta, Suntou-gun (JP); Yasunori Toriyama, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 350 days.

(21) Appl. No.: 12/950,727

(22) Filed: Nov. 19, 2010

(65) Prior Publication Data

US 2011/0158703 A1 Jun. 30, 2011

(30) Foreign Application Priority Data

Dec. 25, 2009 (JP) ..... 2009-294014

(51) Int. Cl.
*G03G 21/18* (2006.01)
*G03G 15/08* (2006.01)

(52) U.S. Cl.
USPC ..... 399/279; 399/111; 399/119

(58) Field of Classification Search
USPC ..... 399/279, 119, 111, 113, 117
See application file for complete search history.

(56) References Cited

U.S. PATENT DOCUMENTS

| | | | | |
|---|---|---|---|---|
| 6,223,010 | B1 | 4/2001 | Araki | |
| 8,032,057 | B2 * | 10/2011 | Takahashi et al. | 399/119 |
| 2007/0036580 | A1 * | 2/2007 | Noh | 399/111 |
| 2009/0238603 | A1 | 9/2009 | Kusudo | |

FOREIGN PATENT DOCUMENTS

| | | | |
|---|---|---|---|
| JP | 2000-263550 | A | 9/2000 |
| JP | 2001-100670 | A | 4/2001 |
| JP | 2007-298829 | A | 11/2007 |
| JP | 2008-033271 | A | 2/2008 |

* cited by examiner

*Primary Examiner* — Sophia S Chen
(74) *Attorney, Agent, or Firm* — Canon USA, Inc., IP Division

(57) ABSTRACT

A developing apparatus includes a developer bearing member, a supporting portion, an urging unit, and a movement regulating member. The developer bearing member rotates while bearing developer. The supporting portion rotatably and movably supports the developer bearing member and includes a recessed portion that is formed into a concave shape. The urging unit urges the developer bearing member in a predetermined direction of the rotational axis direction. The movement regulating member is fitted to an end of the developer bearing member and is movable together with the developer bearing member. The movement regulating member may move to a first position where movement in a perpendicular direction is regulated by coming into contact with a portion of the supporting portion and a second position that is a position apart from the first position and movable in the perpendicular direction without coming into contact with the portion of the supporting portion.

8 Claims, 8 Drawing Sheets

DEVELOPING APPARATUS AND PROCESS CARTRIDGE

BACKGROUND OF THE INVENTION

1. Field of the Invention

The present invention relates to a developing apparatus included in an image forming apparatus such as a copying machine and a printer that forms an image on a recording medium by adopting an electrophotography system and a process cartridge detachable from the image forming apparatus.

2. Description of the Related Art

Electrophotography includes reproducing an original document by light bounced directly from the original to produce an electrostatic latent image on a photoconductive member. The electrostatic latent image is made visible by development using a developer bearing member, such as a rotatable cylinder, to support and transport dry developer material to a position where it is attracted to the latent image by an electrostatic force. Developing apparatuses whose product life has been reached and process cartridges (hereinafter, referred to as "cartridges") are separated by part and material for recycling. For example, a developer bearing member as a process unit is cleaned and inspected to be reused as a process unit or materials for recycling. Product designs considering improvement of disassembly properties of parts are demanded to simplify disassembly and the recycling process and to improve efficiency thereof.

Conventionally, for disassembly of a cartridge or removal of recycling target parts, as discussed in Japanese Patent Application Laid-Open No. 2008-33271, a container frame is cut or a supporting member is removed. Moreover, when a container frame is cut by laser, as discussed in Japanese Patent Application Laid-Open No. 2000-263550, high efficiency of disassembly and recycling process is realized by protecting the recycling target parts by a resin material hard to be cut by laser and configuring the surrounding thereof by a resin material easy to be cut by laser.

In the process cartridge discussed in Japanese Patent Application Laid-Open No. 2008-33271, when a photosensitive drum is removed from a bearing member of the photosensitive drum, the photosensitive drum can be removed from a cleaning frame after the bearing member is removed from the cleaning frame by loosening screws. In this case, if the photosensitive drum can be removed without removing the bearing member from the cleaning frame, the convenience for the user will be increased.

In a process cartridge discussed in Japanese Patent Application Laid-Open No. 2000-263550, there is a burden that reusable resin products must be cut by laser. In this case, if cutting by laser becomes unnecessary, the convenience for the user will be increased.

SUMMARY OF THE INVENTION

The present invention is directed to a developing apparatus that further improves disassembly properties of the developing apparatus.

According to an embodiment, a developing apparatus includes a developer bearing member, a supporting portion, an urging unit, and a movement regulating member. The developer bearing member rotates while bearing developer. The supporting portion rotatably and movably supports the developer bearing member and includes a recessed portion that is formed into a concave shape. The urging unit urges the developer bearing member in a predetermined direction of the rotational axis direction. The movement regulating member is fitted to an end of the developer bearing member and is movable together with the developer bearing member. The movement regulating member may move to a first position where movement in a perpendicular direction is regulated by coming into contact with a portion of the supporting portion and a second position that is a position apart from the first position and movable in the perpendicular direction without coming into contact with the portion of the supporting portion.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to describe the principles of the invention.

DESCRIPTION OF THE EMBODIMENTS

Various exemplary embodiments, features, and aspects of the invention will be described in detail below with reference to the drawings.

Dimensions, materials, and shapes of components described in the exemplary embodiments and their relative positions are to be changed depending on a configuration of an apparatus to which the present invention is applied or various conditions if necessary and thus, if not specifically mentioned, the scope of the present invention is not limited only to such dimensions, materials, and shapes or relative positions.

Figure 1:
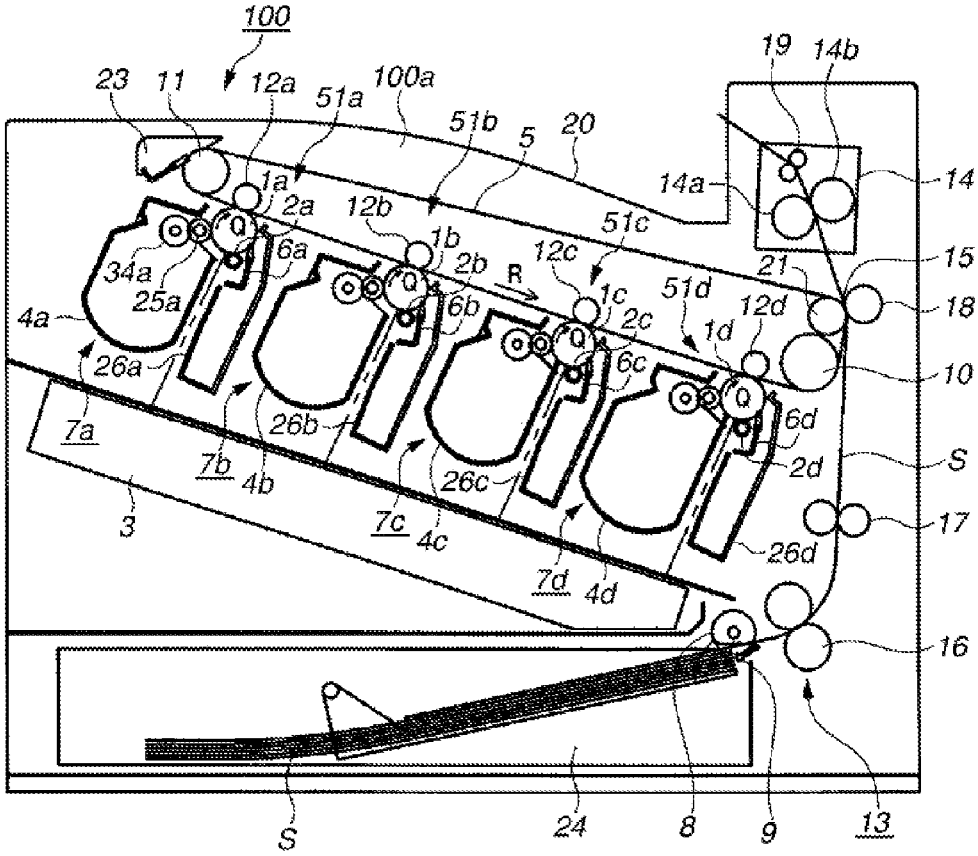
FIG. 1 is a sectional view illustrating a configuration of an image forming apparatus according to an exemplary embodiment of the present invention.

FIG. 1 is a sectional view illustrating a configuration of an image forming apparatus 100 according to an exemplary embodiment of the present invention. The image forming apparatus 100 is a color electrophotographic image forming apparatus using an electrophotographic image forming process. As illustrated in FIG. 1, the image forming apparatus 100 includes an image forming apparatus main body (hereinafter, referred to simply as an "apparatus main body") 100*a* and image forming units 51*a*, 51*b*, 51*c*, and 51*d* to form an image are provided inside the apparatus main body 100*a*.

The image forming units 51*a*, 51*b*, 51*c*, and 51*d* includes electrophotographic photosensitive drums (hereinafter, simply referred to as "photosensitive drums") 1*a*, 1*b*, 1*c*, and 1*d* which are "image bearing members" and primary transfer rollers 12*a*, 12*b*, 12*c*, and 12*d* which are "transfer devices", respectively. At least the photosensitive drums 1*a*, 1*b*, 1*c*, and 1*d* are respectively included in process cartridges (hereinafter, referred to simply as "cartridges") 7*a*, 7*b*, 7*c*, and 7*d* which are "developing apparatuses" and are incorporated into the apparatus main body 100*a*.

The four cartridges 7*a*, 7*b*, 7*c*, and 7*d* which are arranged in parallel with each other and inclined toward the horizontal direction can be mounted on the image forming apparatus 100. The mounted cartridges 7*a* to 7*d* include the photosensitive drums 1*a*, 1*b*, 1*c*, and 1*d* respectively.

The photosensitive drums 1*a*, 1*b*, 1*c*, and 1*d* are driven to rotate clockwise in FIG. 1 by a driving member (not illustrated). Around the photosensitive drums 1*a*, 1*b*, 1*c*, and 1*d*, below described process units which act on the photosensitive drums 1*a*, 1*b*, 1*c*, and 1*d* in turn according to a rotation direction thereof are arranged. More specifically, cleaning members 6*a* to 6*d* that remove developer (toner) remaining on a surface of the photosensitive drums 1*a*, 1*b*, 1*c*, and 1*d* after transfer and charging rollers 2*a* to 2*d* that uniformly charge the surface of the photosensitive drums 1*a*, 1*b*, 1*c*, and 1*d* are arranged. Further, developing units 4*a* to 4*d* which are developing apparatuses for developing an electrostatic image by toner are arranged.

Furthermore, a scanner unit 3 that forms an electrostatic image on the photosensitive drums 1*a*, 1*b*, 1*c*, and 1*d* by radiating laser beams based on image information and an intermediate transfer belt 5 to which toner images of four colors on the surface of the photosensitive drums 1*a*, 1*b*, 1*c*, and 1*d* are transferred together are arranged.

The photosensitive drums 1*a*, 1*b*, 1*c*, and 1*d*, the cleaning members 6*a*, 6*b*, 6*c*, and 6*d*, the charging rollers 2*a*, 2*b*, 2*c*, and 2*d*, and the developing units 4*a*, 4*b*, 4*c*, and 4*d* are integrally formed into cartridges to constitute the cartridges 7*a*, 7*b*, 7*c*, and 7*d* respectively. These cartridges 7*a* to 7*d* are removably mounted on the apparatus main body 100*a* of the image forming apparatus 100 by a user.

The intermediate transfer belt 5 is stretched on a driving roller 10, a tension roller 11, and a suspension roller 21. The primary transfer rollers 12*a*, 12*b*, 12*c*, and 12*d* are disposed inside the intermediate transfer belt 5 facing to the respective photosensitive drums 1*a*, 1*b*, 1*c*, and 1*d*. Then, a transfer bias is applied to the intermediate transfer belt 5 by a bias application unit (not illustrated).

Each of the photosensitive drums 1*a*, 1*b*, 1*c*, and 1*d* rotates in the direction of an arrow Q and the intermediate transfer belt 5 rotates in the direction of an arrow R. Toner images formed on the photosensitive drums 1*a*, 1*b*, 1*c*, and 1*d* are primarily transferred to the surface of the intermediate transfer belt 5 one after another by applying a positive bias to the primary transfer rollers 12*a*, 12*b*, 12*c*, and 12*d*. Then, the toner images of four colors superimposed on the intermediate transfer belt 5 are conveyed to a secondary transfer unit 15.

A sheet S, a recording medium, is conveyed by a conveyance unit composed of a feeding apparatus 13, a registration roller pair 17, and the like in synchronization with an image forming operation. The feeding apparatus 13 includes a feeding cassette 24 for storing the sheet S, a feeding roller 8 for feeding the sheet S, and a conveyance roller pair 16 for conveying the fed sheet S. The feeding cassette 24 can be pulled out in a forward direction of the apparatus main body 100*a*. The sheet S stored in the feeding cassette 24 is brought into press contact with the feeding roller 8, separated one sheet after another by a separation pad 9 (friction separation method), and conveyed.

Then, the sheet S conveyed from the feeding apparatus 13 is further conveyed to the secondary transfer unit 15 by the registration roller pair 17. In the secondary transfer unit 15, a positive bias is applied to a secondary transfer roller 18. Accordingly, the toner images of four colors on the intermediate transfer belt 5 are secondarily transferred to the conveyed sheet S.

A fixing unit 14 is used to fix the toner image formed on the sheet S by adding heat and pressure. A fixing belt 14*a* has a cylindrical shape and is guided by a belt guide member (not illustrated) to which a heating unit such as a heater is bonded. The fixing belt 14*a* and a pressure roller 14*b* form a fixing nip with a predetermined pressure contact force.

The sheet S on which an unfixed toner image conveyed from the image forming units is heated and pressurized by the fixing nip between the fixing belt 14*a* and the pressure roller 14*b*. Then, the unfixed toner image on the sheet S is fixed thereto. Subsequently, the sheet S onto which the toner image is fixed is discharged to a discharge tray 20 by a discharge roller pair 19.

On the other hand, toner remaining on the surface of the photosensitive drums 1*a* to 1*d* after the toner image being transferred is removed by the cleaning members 6*a* to 6*d*. The removed toner is recovered into removed toner chambers inside photosensitive units 26*a* to 26*d*.

Toner remaining on the intermediate transfer belt 5 is after the secondary transfer to the sheet S is removed by a transfer belt cleaning apparatus 23. The removed toner passes through a waste toner conveyance path (not illustrated) and is recovered into a waste toner recovery container (not illustrated) arranged on the back surface of the apparatus.

In a first exemplary embodiment, a configuration in which the intermediate transfer belt 5 is arranged facing to the photosensitive drums 1*a* to 1*d* and a toner image is transferred from the intermediate transfer belt 5 to the sheet S is exemplified, but the first exemplary embodiment is not limited to this configuration. More specifically, the first exemplary embodiment may have a configuration in which a sheet conveyance belt which is a recording medium conveyance body for conveying the sheet S is arranged facing to the photosensitive drums 1*a* to 1*d* and toner images are transferred from the photosensitive drums 1*a* to 1*d* to the sheet S.

Figure 2A:
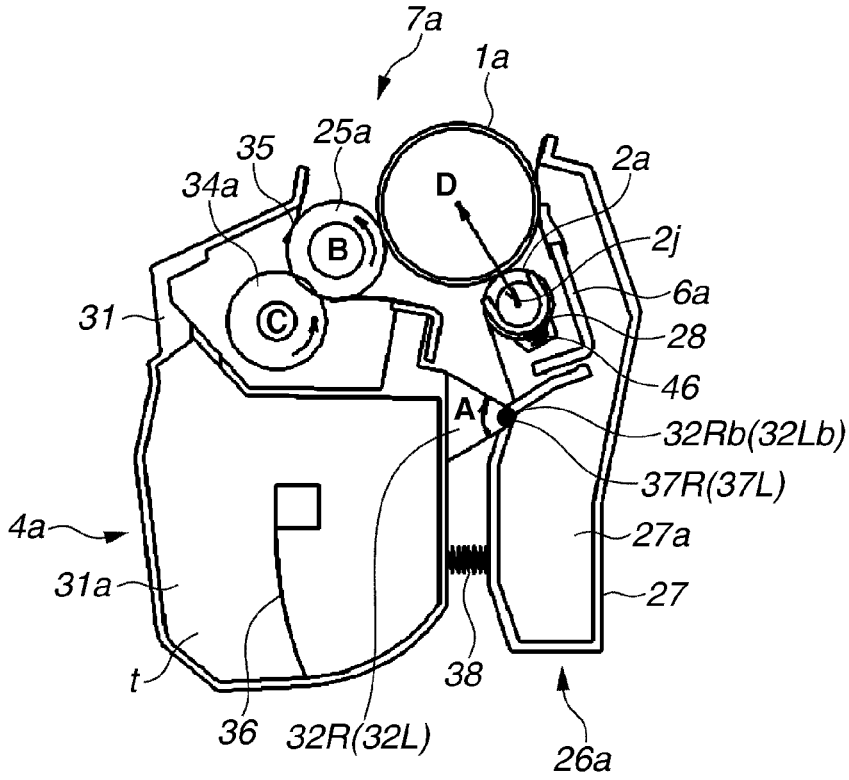
FIGS. 2A and 2B are a sectional view and the like illustrating a configuration of a cartridge.

FIG. 2A is a sectional view illustrating a configuration of a cartridge 7*a*. The cartridge 7*a* contains toner t. The cartridge 7*a* containing the toner t in yellow, a cartridge 7*b* containing the toner t in magenta, a cartridge 7*c* containing the toner t in cyan, and a cartridge 7*d* containing the toner t in black have the same configuration. The cartridge 7*a* can be divided into the photosensitive unit 26*a* including the photosensitive drum 1*a*, the charging roller 2*a* as a charging unit, and the cleaning member 6*a* as a cleaning unit, and the developing unit 4*a* including a developing roller 25*a* as a developer bearing member which is a developing unit.

The photosensitive drum 1*a* is freely rotatably mounted on a cleaning frame 27 of the photosensitive unit 26*a* via a bearing (not illustrated). A driving force of a driving motor (not illustrated) is transmitted to the photosensitive unit 26*a*, and accordingly the photosensitive drum 1*a* is driven to rotate according to an image forming operation. As described above, the charging roller 2*a* and the cleaning member 6*a* are arranged on the circumference of the photosensitive drum 1*a*. Further, residual toner removed from the surface of the photosensitive drum 1*a* by the cleaning member 6*a* falls into a removed toner chamber 27*a*.

A charging roller bearing 28 is mounted on the cleaning frame 27 movably in the direction of an arrow D passing through the center of the charging roller 2*a* and that of the photosensitive drum 1*a*. An axis 2*j* of the charging roller 2*a* is rotatably mounted on the charging roller bearing 28. The charging roller bearing 28 is in a state where pressure is applied by a charging roller pressurizing member 46 toward the photosensitive drum 1*a*.

The developing unit 4*a* includes the developing roller 25*a* that rotates in the direction of an arrow B by being in contact with the photosensitive drum 1*a* and a development frame 31. The developing roller 25*a* is freely rotatably supported by the development frame 31 via supporting members (supporting portion) 32R and 32L provided on both sides in the longitudinal direction of the development frame 31. The developing roller is also supported movably in the rotational axis direction to the supporting members. Details of the support of the developing roller 25*a* by the supporting members 32R and 32L of the developing roller 25*a* will be described below.

Moreover, a toner feeding roller 34*a* that rotates in the direction of an arrow C by being in contact with the developing roller 25*a* and a developing blade 35 for regulating a toner layer on the developing roller 25*a* are arranged on the circumference of the developing roller 25*a*. Further, a toner conveyance member 36 for stirring contained toner and conveying the toner to the toner feeding roller 34*a* is provided in a toner storage unit 31*a* of the development frame 31.

The developing unit 4*a* is freely rotatably connected to the photosensitive unit 26*a* around axes 37R and 37L fitted into holes 32Rb and 32Lb provided, for example, in the supporting members 32R and 32L. The developing unit 4*a* is urged by a pressure spring 38 so that the developing roller 25*a* included in the developing unit 4*a* essentially is forced by the pressure spring 38 to abut on the photosensitive drum 1*a* included in the photosensitive unit 26*a*. When an image is formed by the cartridge 7*a*, the developing unit 4*a* rotates in the direction of an arrow A around the axes 37R and 37L, so that the developing roller 25*a* abuts on the photosensitive drum 1*a*.

Figure 2B:
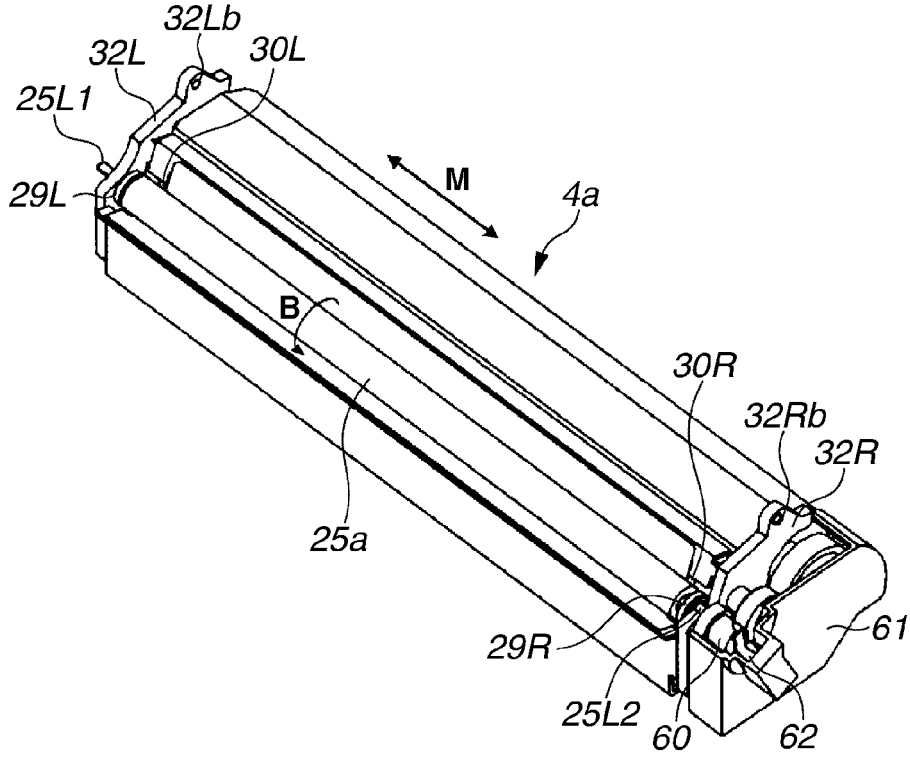

FIG. 2B is a perspective view illustrating the configuration of the developing unit 4*a*. As illustrated in FIG. 2B, the developing unit 4*a* includes the supporting member 32R and the supporting member 32L. Both sides of the developing roller 25*a* are supported by the supporting member 32R and the supporting member 32L, and the developing roller 25*a* is freely rotatable while being supported by the supporting member 32R and the supporting member 32L. For example, a driving input member (not illustrated) is provided at one end 25L1, which is an "axis" of the developing roller 25*a*. The developing roller 25*a* rotates in the direction of an arrow B by receiving a rotation driving force from the driving input member of the developing roller 25*a*. An end member (movement regulating member) 60 is provided at the other end 25L2, which is an "axis" of the developing roller 25*a*, by engaging thereinto. Further, a protection member 61 is provided outside the end member 60 to cover the end member 60.

Spacers 29R and 29L are provided at both ends of the developing roller 25*a* and inside the supporting members 32R and 32L. When the developing roller 25*a* and the photosensitive drum 1*a* come into contact with each other, the spacers 29R and 29L at both ends of the developing roller 25*a* abut on the photosensitive drum 1*a*. Thus, a distance between the axis of the developing roller 25*a* and that of the photosensitive drum 1*a* is maintained constant.

Figure 3A:
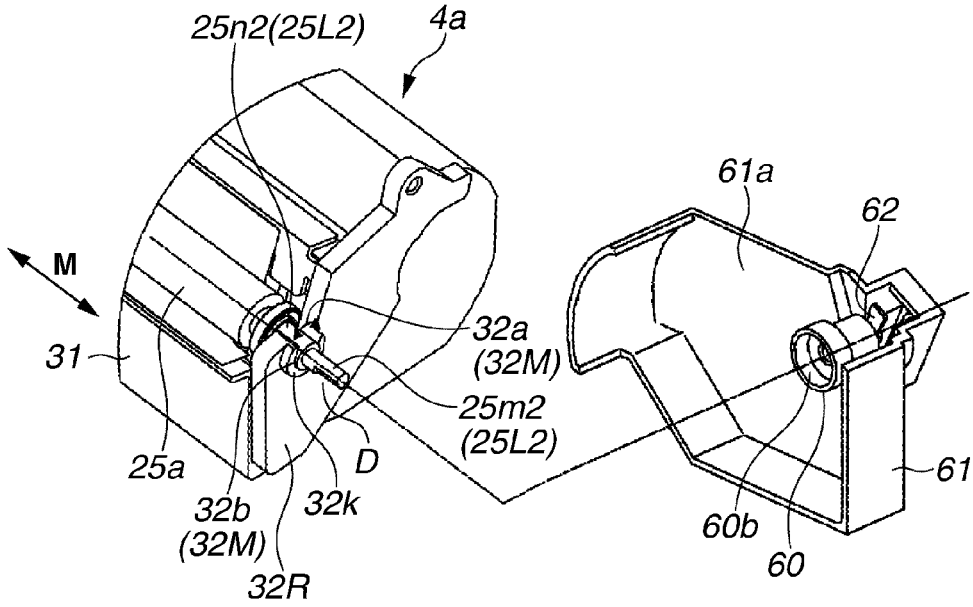
FIGS. 3A and 3B are an exploded perspective view and the like illustrating a configuration of a developing unit from which an end member and a protection member are removed.

FIG. 3A is an exploded perspective view illustrating the configuration of the developing unit 4*a* from which the end member 60 and the protection member 61 are removed. Parts that are not involved in the connection of the developing roller 25*a*, the end member 60, and the protection member 61 are not illustrated to simplify the description. The developing roller 25*a*, which is a "developer bearing member" illustrated in FIG. 3A, bears a developer. In other words, developing roller 25*a* is a structural member that supports a developer material, such as a dry developer material to develop an electrostatic image, as a way of bearing that developer material. The developing roller 25*a* includes the one end 25L1 of the axis and the other end 25L2 of the axis (see FIG. 4). The one end 25L1 of the axis includes a one end-side minor diameter portion 25*m*1 whose diameter is small and a one end-side major diameter portion 25*n*1 whose diameter is large, and the one end-side minor diameter portion 25*m*1 is positioned on the outer side from the one end-side major diameter portion 25*n*1 (see FIG. 4). The other end 25L2 of the axis includes another end-side minor diameter portion 25*m*2 whose diameter is small and another end-side major diameter portion 25*n*2 whose diameter is large, and the other end-side minor diameter portion 25*m*2 is positioned on the outer side from the other end-side major diameter portion 25*n*2 (see FIG. 4).

On the other hand, the supporting member 32R includes a recessed portion (concave portion) 32M that is formed into a concave shape in the direction perpendicular to the axis of the developing roller 25*a* and supports the developing roller 25*a* freely rotatably inside the recessed portion 32M while the axis of the developing roller 25*a* is inserted into the recessed portion 32M. The recessed portion 32M includes an opening 32*a* through which the other end-side major diameter portion 25*n*2 is exposed and a sliding unit 32*b* that slides together with the other end-side major diameter portion 25*n*2 (see FIG. 4).

An engaging rib 32*k* is a "peripheral projecting portion (projecting portion)" projecting in a rotational axis direction M (more precisely, the axis direction M and the direction of the protection member 61) of the developing roller 25*a*. The engaging rib 32*k* is formed on the periphery of the recessed portion 32M of the supporting member 32R. The engaging rib 32*k* is a part of the supporting member 32R. The engaging rib 32*k* projects toward the outer side in the axis direction of the developing roller 25*a* to reinforce reception of the other end-side major diameter portion 25*n*2 which is the "axis" of the developing roller 25*a*. The above described recessed portion 32M is formed extending over the thickness of the supporting member 32R and the engaging rib 32*k*.

Regarding a relationship between the developing roller 25*a* and the supporting member 32R described above, a "regulation control unit" is present. The protection member 61, the end member (movement regulating member) 60, and an urging member (urging unit) 62 which form the "regulation control unit" are engaged with the engaging rib 32*k* of the supporting member 32R to regulate the developing roller 25*a* from being detached from the recessed portion 32M by pressing the developing roller 25*a* in the direction (predetermined direction) of the one end 25L1 of the axis of the developing roller 25*a*. Also, the protection member 61, the end member 60, and the urging member 62 which form the "regulation control unit" are disengaged from the engaging rib 32*k* of the supporting member 32R when the developing roller 25*a* is pressed in the direction of the other end 25L2 of the axis of the developing roller 25*a* (the opposite direction of the predetermined direction), and enables the developing roller 25*a* to be freely removed from the recessed portion 32M.

First, the protection member 61 includes a plate portion 61*a* mounted in the axis direction M of the developing roller 25*a* and on the outer side from the supporting member 32R to protect an inner side thereof. A part of the driving apparatus may be contained inside the protection member 61. In the present exemplary embodiment, various gears are arranged (see FIG. 3B).

The end member 60 includes a gear unit 60*a* and a flange unit 60*b*. The end member 60 engages with the other end-side minor diameter portion 25*m*2 of the other end 25L2, which is the "axis" of the developing roller 25*a*, and can freely move in the axis direction M of the developing roller 25*a* integrally therewith. The end member 60 moves to the direction toward the supporting member 32L, when viewed from the direction of the opening 32*a* of the recessed portion 32M, and takes a first position X overlapping with the supporting member 32R. If the end member 60 takes the first position X, the flange unit 60*b* of the end member 60 is engaged with the engaging rib 32*k* of the supporting member 32R.

Further, the end member 60 also moves in the direction of the protection member 61, when viewed from the direction of the opening 32*a* of the recessed portion 32M, and takes a second position Y that does not overlap with the supporting member 32R. If the end member 60 takes the second position Y, the flange unit 60*b* of the end member 60 is disengaged from the engaging rib 32*k* of the supporting member 32R. See FIG. 4 for the state of the first position X and FIGS. 8A and 8B for the state of the second position Y.

The urging member 62 is mounted on an inner side surface of the plate portion 61*a* of the protection member 61 to urge the end member 60 toward the developing roller 25*a* by applying a force in a predetermined direction. The urging member 62 is always in contact with an end face of the end member 60 to urge the end member 60 in the direction of the developing roller 25*a*. Thus, the urging member 62 is provided between the end member 60 and the protection member 61.

The other end-side minor diameter portion 25*m*2 of the developing roller 25*a* and the end member 60 described below are connected by a phase determining shape such as a D cut. Further, as described above, the opening 32*a* is provided to the supporting member 32R which rotatably supports the developing roller 25*a* and thus, the other end 25L2 of the developing roller 25*a* is exposed so that the developing roller 25*a* can be removed from the supporting member 32R. The engaging rib 32*k* having a u-shape is provided near the supporting unit of the developing roller 25*a* of the supporting member 32R. On the other hand, the end member 60 has the flange unit 60*b* provided thereon. An outer diameter portion of the engaging rib 32*k* is equal to or smaller than an inner diameter portion of the flange unit 60*b* of the end member 60 and both are fitted. Details of the positional relationship between the supporting member 32R and the end member 60 will be described below.

Figure 3B:
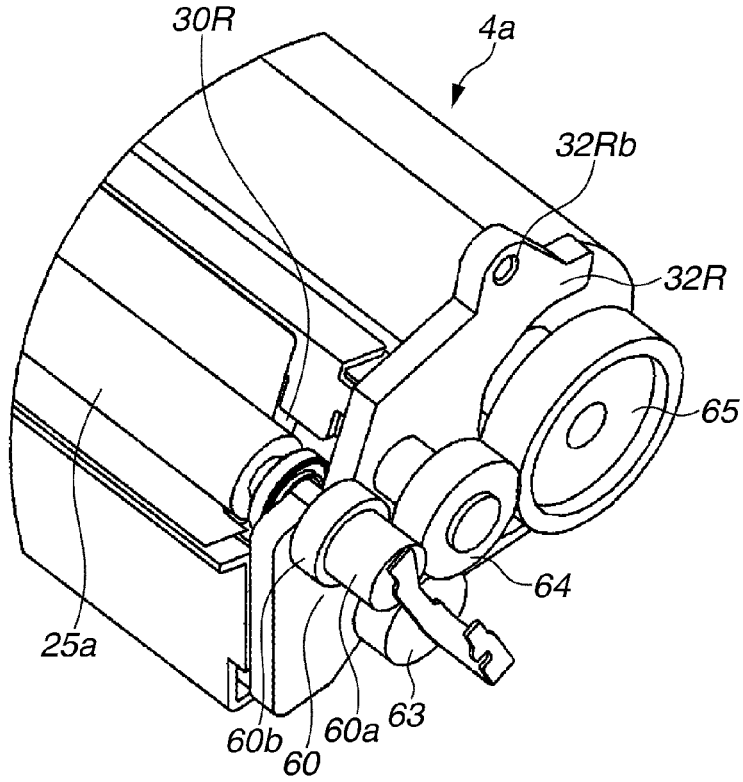

FIG. 3B is a perspective view illustrating the configuration of the developing unit 4*a* from which the protection member 61 is removed. A toner feeding roller gear 63 that transmits driving to the toner feeding roller 34*a* and a toner conveyance gear 65 that transmits driving to the toner conveyance member 36 are provided at an end of the developing unit 4*a*. The end member 60 includes the gear unit 60*a* and the flange unit 60*b*. The gear unit 60*a* of the end member 60 constitutes a driving gear train together with the toner feeding roller gear 63, the toner conveyance gear 65, and an idler gear 64. Driving from a driving input source is transmitted from the gear unit 60*a* of the end member 60 to the toner feeding roller gear 63 or the toner conveyance gear 65 via the idler gear 64.

Figure 4:
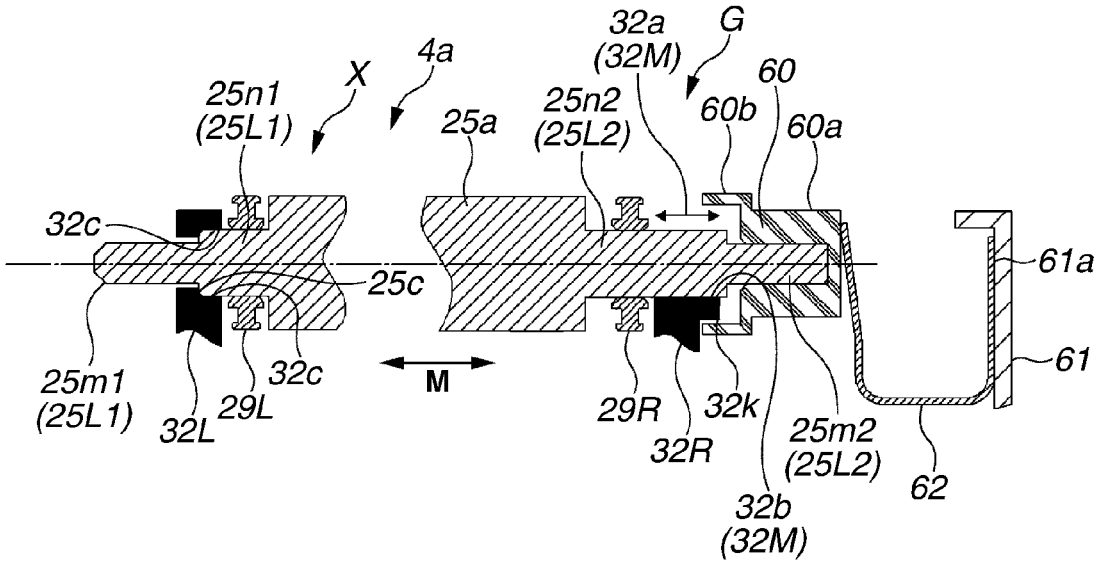
FIG. 4 is a sectional view illustrating a configuration of the developing unit.

FIG. 4 is a sectional view illustrating the configuration of the developing unit 4*a*. Details of the positional relationship between the supporting member 32R and the end member 60 will be described. FIG. 4 is a sectional view of the developing unit 4*a* including peripheral components for connection and fitting of the developing roller 25*a*, the supporting member 32R, and the end member 60.

The developing roller 25*a* receives an urging force from the urging member 62 in the left direction in FIG. 4 together with the end member 60. The developing roller 25*a* has a step portion 25*c* formed between the one end-side minor diameter portion 25*m*1 and the one end-side major diameter portion 25*n*1. With the step portion 25*c* abutting on the supporting member 32L in the axis direction M (the step portion 25*c* coming into contact with a step portion 32*c* of the supporting member 32L), the developing roller 25*a* is positioned. The engaging rib 32*k* of the supporting member 32R and the flange unit 60*b* of the end member 60 are in a fitting relationship. FIG. 4 illustrates a case where the outer diameter portion of the engaging rib 32*k* is smaller than the inner diameter portion of the flange unit 60*b* of the end member 60 and a state of fitting with a gap.

Components in contact with the developing roller 25*a* include, seal members 30R and 30L (see FIGS. 2B and 3B) that prevent developer from flying out and leaking from the development frame 31 by regulating the developer inside the development frame 31, the developing blade 35 for regulating a toner layer on the developing roller 25*a*, and further the toner feeding roller 34*a* that feeds the developer to the developing roller 25*a*, the photosensitive drum 1*a*, the end member 60 and a gear train thereof that transmit driving to the toner feeding roller 34*a*. The directions of forces received by the developing roller 25*a* while driving (during an image formation operation) and resting will be described below one by one for each component using drawings.

Figure 5A:
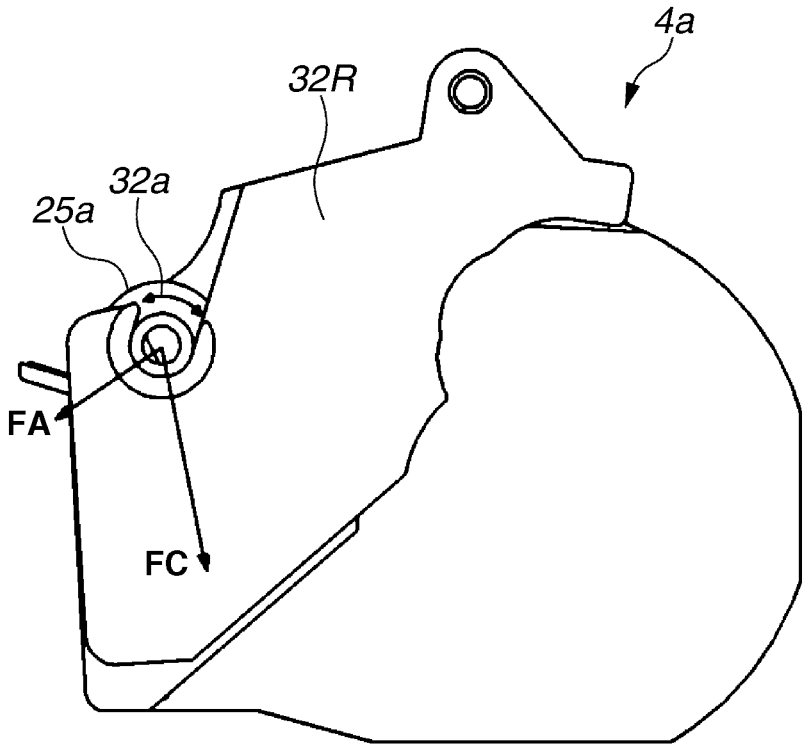
FIGS. 5A and 5B are side views illustrating a configuration of a developing roller and a supporting member.

FIG. 5A is a side view illustrating the configuration of the developing roller 25*a* and the supporting member 32R. In the supporting member 32R, the opening 32*a* is formed to allow the developing roller 25*a* to be removed. The supporting member 32R positions the developing roller 25*a* based on the relation of forces acting on the developing roller 25*a* described below and rotatably supports the developing roller 25*a*.

Figure 5B:
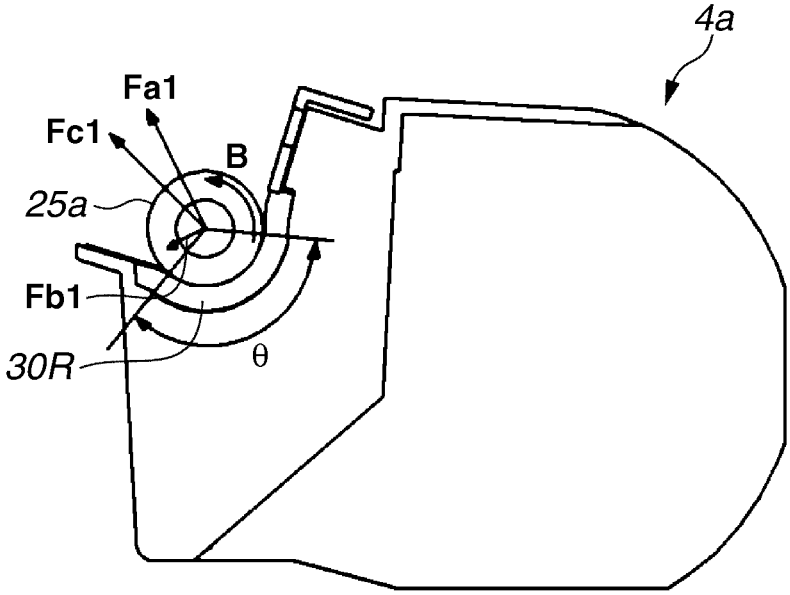

FIG. 5B is a side view illustrating the configuration of the developing roller 25*a* and the seal member 30R. As illustrated in FIG. 5B, the developing roller 25*a* is in contact with the seal member 30R. The seal member 30R is in contact with the developing roller 25*a* within a fixed phase range θ of the outer circumference of the developing roller 25*a*. The seal member 30R is in contact with the developing roller 25*a* with predetermined pressure to prevent, as described above, the developer from flying out and leaking from the frame by regulating the developer inside the development frame 31. Through the contact with the seal member 30R, the developing roller 25*a* receives a force in the direction of an arrow Fa1 (when resting). If the developing roller 25*a* rotates in the direction of an arrow B, the developing roller 25*a* receives a frictional force generated on a contact portion on the seal member 30R in the direction of an arrow Fb1. Thus, the developing roller 25*a* receives a force in the direction of an arrow Fc1 that is a resultant force of the frictional force and the force in the direction of the arrow Fa1 when resting.

Figure 6A:
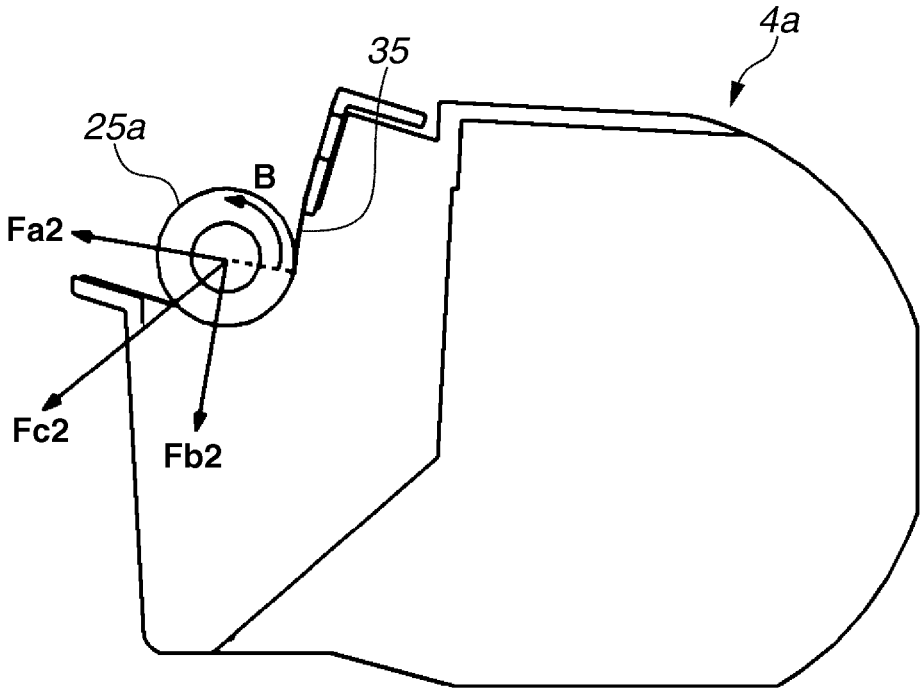
FIGS. 6A and 6B are side views illustrating a configuration of a developing roller and a developing blade.

FIG. 6A is a side view illustrating the configuration of the developing roller 25*a* and the developing blade 35. As illustrated in FIG. 6A, the developing blade 35 is in contact with the developing roller 25*a*. To regulate a toner layer on the developing roller 25*a*, the developing blade 35 is in contact with the developing roller 25*a* with fixed pressure. Through the contact with the developing blade 35, the developing roller 25*a* receives a force in the direction of an arrow Fa2 (when resting). If the developing roller 25*a* rotates in the direction of the arrow B, the developing roller 25*a* receives a frictional force generated on a contact portion with the developing blade 35 in the direction of an arrow Fb2. Thus, the developing roller 25*a* receives a force in the direction of an arrow Fc2 as a resultant force of the frictional force and the force in the direction of the arrow Fa2 when resting.

Figure 6B:
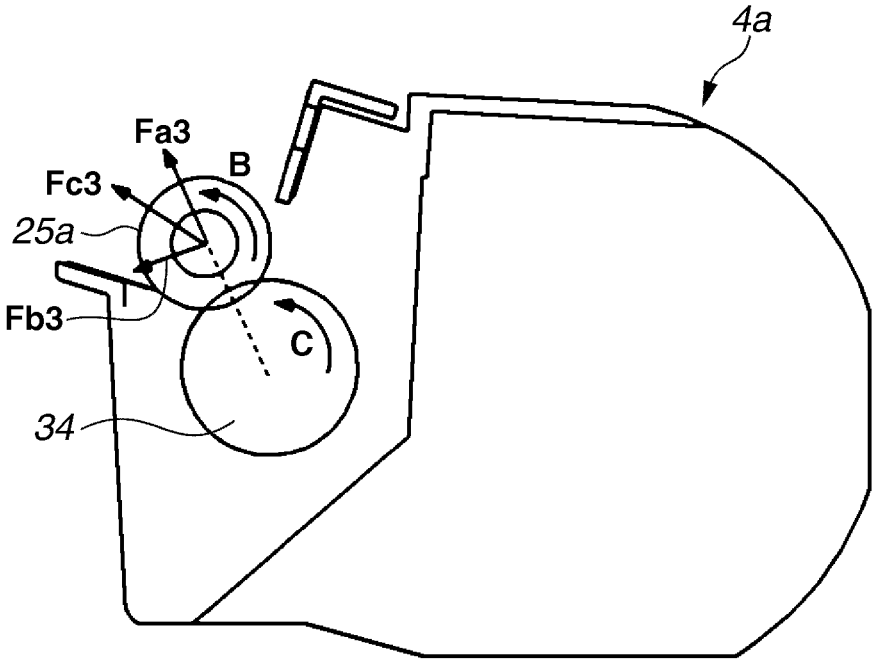

FIG. 6B is a side view illustrating the configuration of the developing roller 25*a* and the toner feeding roller 34*a*. As illustrated in FIG. 6B, the toner feeding roller 34*a* is in contact with the developing roller 25*a*. To feed developer to the developing roller 25*a*, a surface layer of the toner feeding roller 34*a* is constituted of, for example, a urethane foam and configured to penetrate into the developing roller 25*a* by a fixed amount. Through the contact with the toner feeding roller 34*a*, the developing roller 25*a* receives a force in the direction of an arrow Fa3 (when resting).

The developing roller 25*a* rotates in the direction of the arrow B or the toner feeding roller 34*a* rotates in the direction of an arrow C. Then, the developing roller 25*a* receives a frictional force generated in a contact portion with the toner feeding roller 34*a* in the direction of an arrow Fb3. Thus the developing roller 25*a* receives a force in the direction of an arrow Fc3 as a resultant force of the frictional force and the force in the direction of the arrow Fa3 when resting.

Figure 7A:
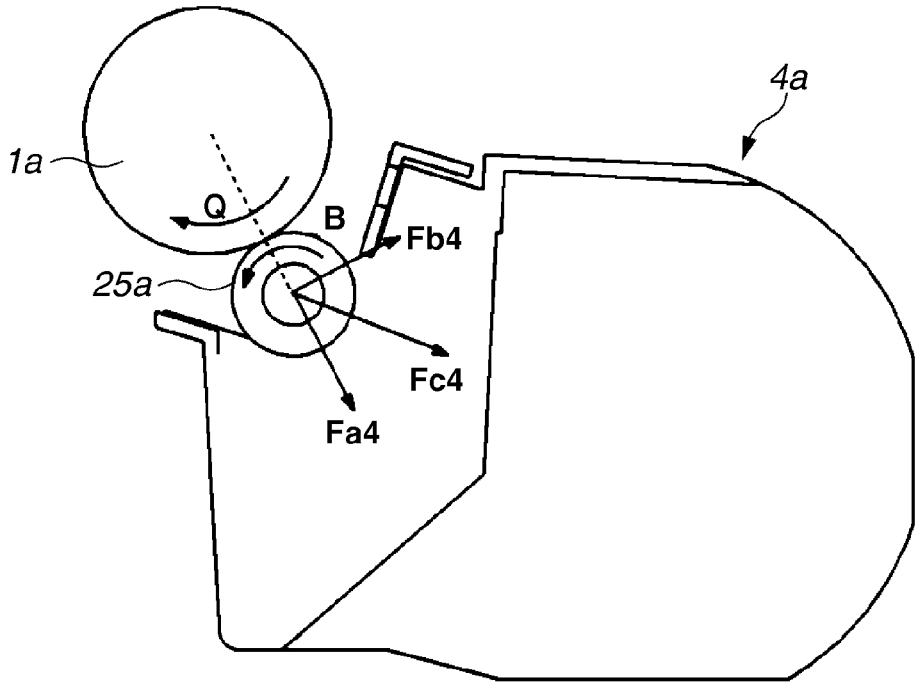
FIGS. 7A and 7B are side views illustrating a configuration of a developing roller and a photosensitive drum.

FIG. 7A is a side view illustrating the configuration of the developing roller 25*a* and the photosensitive drum 1*a*. As illustrated in FIG. 7A, the photosensitive drum 1*a* is in contact with the developing roller 25*a*. Through the contact with the photosensitive drum 1*a*, the developing roller 25*a* receives a force in the direction of an arrow Fa4 (when resting).

The developing roller 25*a* rotates in the direction of the arrow B or the photosensitive drum 1*a* rotates in the direction of an arrow Q. Then, the developing roller 25*a* receives a frictional force generated in a contact portion with the photosensitive drum 1*a* in the direction of an arrow Fb4, and receives a force in the direction of an arrow Fc4, as a resultant force of the frictional force and the force in the direction of the arrow Fa4 when resting. The above description shows a case where a speed of the developing roller 25*a* on the surface layer is faster than that of the photosensitive drum 1*a* on the surface layer. If the speed of the developing roller 25*a* on the surface layer is slower than that of the photosensitive drum 1*a* on the surface layer, the arrow Fb4 is reversed to the opposite direction.

In general, when a latent image on the photosensitive drum 1*a* is developed, a contact development method in which the developing roller 25*a* and the photosensitive drum 1*a* are in contact with each other and a non-contact development method in which the developing roller 25*a* and the photosensitive drum 1*a* are separated from each other for development are known. In the above description, the contact development method is taken as an example. In the non-contact development method, for example, an amount of separation between the developing roller 25*a* and the photosensitive drum 1*a* is regulated by bringing spacers 29R and 29L (see FIGS. 2B and 3B) provided at both ends of the developing roller 25*a* into contact with the photosensitive drum 1*a* with fixed pressure. Also in this case, the spacers 29R and 29L come into contact with the photosensitive drum 1*a* as an alternative to the developing roller 25*a* in FIG. 7A and thus, like the above case, the developing roller 25*a* including the spacers 29R and 29L receives a force in the direction of each arrow.

Figure 7B:
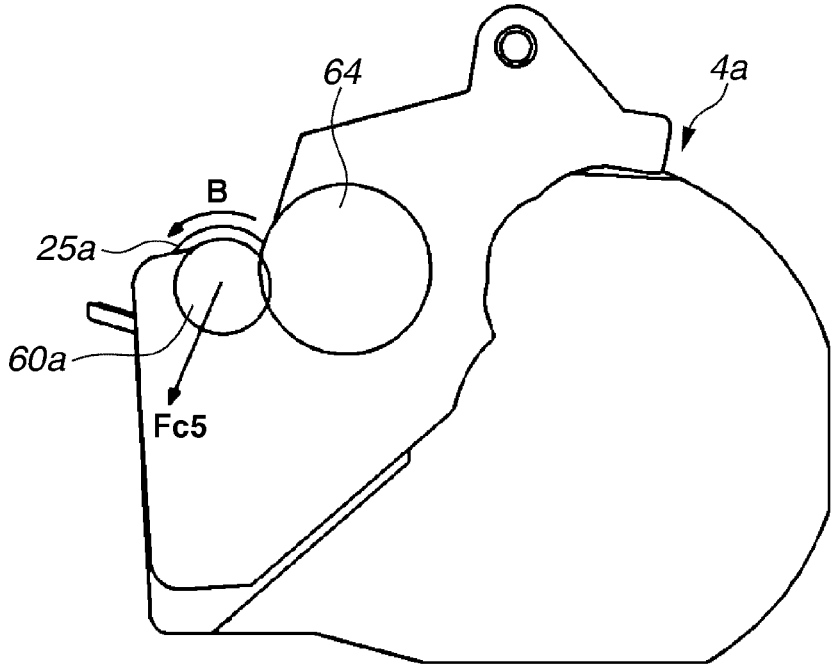

FIG. 7B is a side view illustrating the configuration of the developing roller 25*a* and the idler gear 64. As illustrated in FIG. 7B, the idler gear 64 is in contact with the gear unit 60*a* of the end member 60 provided at an end of the developing roller 25*a* by engaging therewith. When driving is transmitted from the gear unit 60*a* of the end member 60 to the idler gear 64, the end member 60 receives a force in the direction of an arrow Fc5 which is a pressure angle direction of a tooth plane of the idler gear 64, from the tooth plane of the idler gear 64.

The directions of forces that the developing roller 25*a* receives from the above components in contact with the developing roller 25*a*, that is, the seal member 30R, the developing blade 35, the toner feeding roller 34*a*, the photosensitive drum 1*a*, the end member 60, and the gear train thereof have each been described when the developing roller 25*a* rests and rotates. As illustrated in FIG. 5A, the resultant force of such a plurality of forces is in the direction of an arrow FA if the force is received while resting and in the direction of an arrow FC if the force received while driving. More specifically, though the supporting member 32R includes the opening 32*a* to enable the removal of the developing roller 25*a*, the developing roller 25*a* does not receive a force in the direction toward the opening 32*a* regardless of whether the developing roller 25*a* is resting or driven, so that the developing roller 25*a* will not be thrown out of the opening 32*a*.

On the other hand, an unexpected external force may act when the cartridge 7*a* is handled or transported (distributed). Such external forces will be described one by one below using drawings together with a method for removing the developing roller 25*a*.

Returning to FIG. 4, the description of the support configuration of the developing roller 25*a* will be supplemented. As described above, the developing roller 25*a* does not receive any force in the direction toward the opening 32*a* of the supporting member 32R (an upward force in FIG. 4) regardless of whether the developing roller 25*a* is resting or driven, so that the developing roller 25*a* will not be detached from the supporting members 32R and 32L.

When the developing apparatus is handled or transported (distributed), the developing roller 25*a* may receive a force in the direction to the opening 32*a* of the supporting member 32R. However, the engaging rib 32*k* of the supporting member 32R and the flange unit 60*b* of the end member 60 are in a fitting relationship and thus, the end member 60 cannot move upward in FIG. 6. More specifically, the developing roller 25*a* connected to the end member 60 is configured not to be detached from the supporting member 32R. At this time, the supporting member 32R and the end member 60 are overlapped with each other, when viewed from the direction of an arrow G, which is the direction perpendicular to the axis of the developing roller 25*a* and the direction of the opening 32*a* of the supporting member 32R.

Figure 8A:
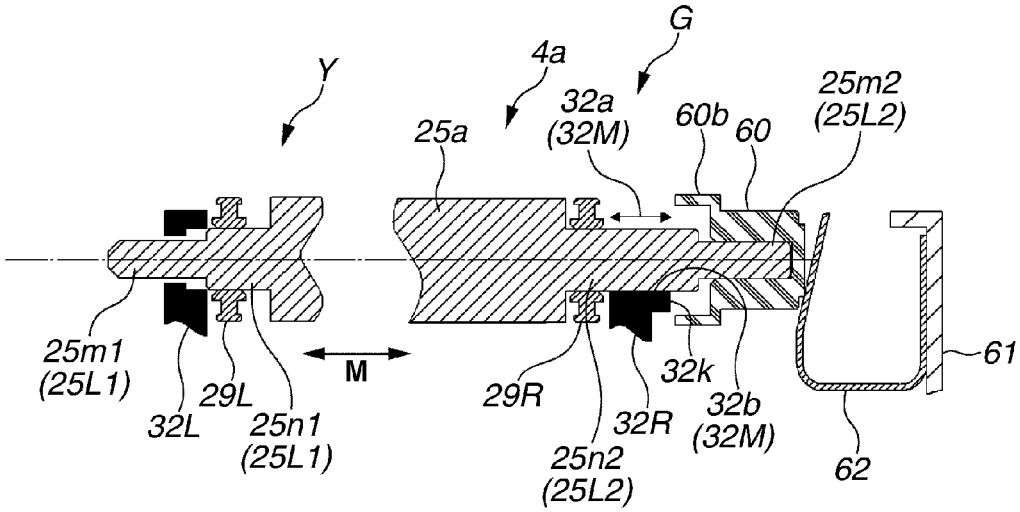
FIGS. 8A and 8B are sectional views illustrating a removal process of a developing unit.
Figure 8B:
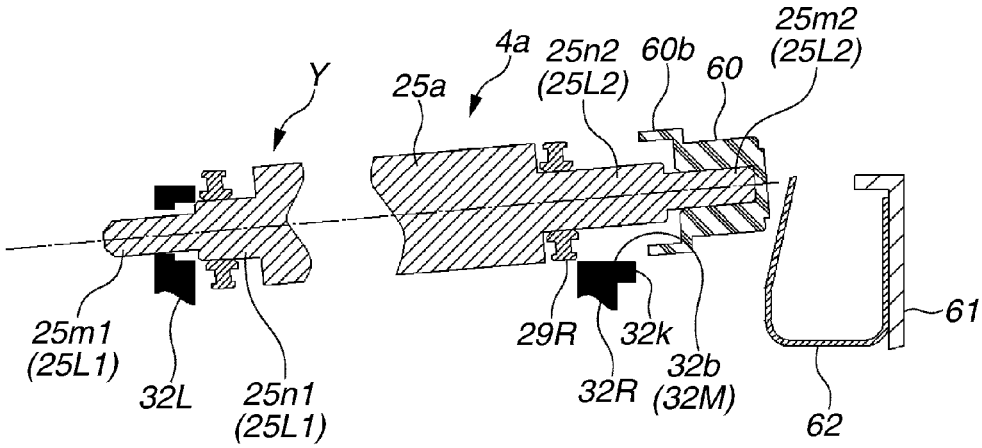

FIG. 8A is a sectional view illustrating a removal process of the developing unit 4*a*. FIG. 8B is a sectional view illustrating the removal process of the developing unit 4*a*. A method for removing the developing roller 25*a* will be described below with reference to FIGS. 8A and 8B.

FIG. 8A illustrates the developing roller 25*a* and the end member 60 moved in the right direction in FIG. 8A from the state of the sectional view of the developing unit 4*a* in FIG. 4 against an urging force of the urging member 62. Normally, the end member 60 receives the urging force from the urging member 62, the engaging rib 32*k* of the supporting member 32R and the flange unit 60*b* of the end member 60 are in a fitting relationship, and the developing roller 25*a* is located at the first position X illustrated in FIG. 4.

If an intentional external force is applied to the developing roller 25*a* and the end member 60 against the urging force from the urging member 62, the engaging rib 32*k* of the supporting member 32R and the flange unit 60*b* of the end member 60 are no longer in a fitting relationship. Then, the developing roller 25*a* takes the second position Y illustrated in FIG. 8A. At this point, the supporting member 32R and the end member 60 are not overlapped with each other, when viewed from the direction of the arrow G, which is the direction perpendicular to the axis of the developing roller 25*a* and the direction to the opening 32*a* of the supporting member 32R. Also at this point, the developing roller 25*a* is movable integrally with the end member 60 in the direction to the opening 32*a* of the supporting member 32R. Then, as illustrated in FIG. 8B, the developing roller 25*a* and the end member 60 can integrally be removed from the supporting member 32R.

With a sequence of operations of the developing roller 25*a* and the end member 60 illustrated in FIGS. 4, 8A, and 8B described above, the developing roller 25*a* and the end member 60 can be easily removed integrally from the developing unit 4*a*.

According to the present invention, when the developing roller 25*a* is removed from the supporting member 32R, the supporting member 32R and the surrounding member (the protection member 61) do not have to be removed. With only the developing roller 25*a* being easily removed, simplification and higher efficiency of the process of disassembling and recycling the cartridge 7*a* are realized.

The exemplary embodiment described above has been described regarding the cartridge 7*a* which is a "developing apparatus", but the present invention is not limited to the above exemplary embodiment. More specifically, the "developing apparatus" may be one fixed to the apparatus main body 100*a*, instead of a cartridge.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-294014 filed Dec. 25, 2009, which is hereby incorporated by reference herein in its entirety.

What is claimed is:

1. A developing apparatus, comprising:

a developer bearing member configured to rotate while bearing developer;

a supporting portion having a concave portion that is formed into a concave shape in a direction perpendicular to a rotational axis direction of the developer bearing member and configured to support the developer bearing member rotatably and movably in the rotational axis direction inside the concave portion;

an urging unit configured to urge the developer bearing member in a predetermined direction of the rotational axis direction; and a movement regulating member fitted to an end of the developer bearing member is configured to be movable together with the developer bearing member, and is configured to be movable to a first position where movement in a perpendicular direction to the rotational axis direction is regulated by coming into contact with a portion of the supporting portion and a second position that is a position apart from the first position in a direction opposite to the predetermined direction and movable in the perpendicular direction without coming into contact with the portion of the supporting portion.

2. The developing apparatus according to claim 1, wherein the portion of the supporting portion is a projecting portion projecting in an opposite direction from a periphery of the recessed portion.

3. The developing apparatus according to claim 1, wherein an outer diameter of a portion of the developer bearing member that fits into the movement regulating member is smaller than an outer diameter of a portion of the developer bearing member supported by the supporting portion.

4. The developing apparatus according to claim 1, further comprising: a protection member arranged on an outer side from the supporting portion in the rotational axis direction and configured to cover an end portion of the developer bearing member, wherein the urging unit is provided in the protection member.

5. A process cartridge detachable from an image forming apparatus main body, the process cartridge comprising:

an image bearing member on which an electrostatic image is formed;

a developer bearing member configured to rotate while supporting developer to develop the electrostatic image;

a supporting portion having a concave portion that is formed into a concave shape in a direction perpendicular to a rotational axis direction of the developer bearing member and configured to support the developer bearing member rotatably and movably in the rotational axis direction inside the concave portion;

an urging unit configured to urge the developer bearing member in a predetermined direction of the rotational axis direction; and a movement regulating member fitted to an end of the developer bearing member is configured to be movable together with the developer bearing member, and is configured to be movable to a first position where movement in a perpendicular direction to the rotational axis direction is regulated by coming into contact with a portion of the supporting portion and a second position that is a position apart from the first position in a direction opposite to the predetermined direction and movable in the perpendicular direction without coming into contact with the portion of the supporting portion.

6. The process cartridge according to claim 5, wherein the portion of the supporting portion is a projecting portion projecting in an opposite direction from a periphery of the recessed portion.

7. The process cartridge according to claim 5, wherein an outer diameter of a portion of the developer bearing member that fits into the movement regulating member is smaller than an outer diameter of a portion of the developer bearing member supported by the supporting portion.

8. The process cartridge according to claim 5, further comprising: a protection member arranged on an outer side from the supporting portion in the rotational axis direction and configured to cover an end portion of the developer bearing member, wherein the urging unit is provided in the protection member.

* * * * *